US007779875B2

(12) United States Patent
Kuivasto et al.

(10) Patent No.: US 7,779,875 B2
(45) Date of Patent: Aug. 24, 2010

(54) METHOD FOR CUTTING VENEER FROM LOGS

(75) Inventors: Timo Kuivasto, Lahti (FI); Antti Pennanen, Lahti (FI); Jussi Puranen, Lahti (FI)

(73) Assignee: Raute Oyj, Nastola (FI)

( * ) Notice: Subject to any disclaimer, the term of this patent is extended or adjusted under 35 U.S.C. 154(b) by 1009 days.

(21) Appl. No.: 10/572,393

(22) PCT Filed: Sep. 22, 2004

(86) PCT No.: PCT/FI2004/050134

§ 371 (c)(1),
(2), (4) Date: Mar. 16, 2006

(87) PCT Pub. No.: WO2005/030448

PCT Pub. Date: Apr. 7, 2005

(65) Prior Publication Data

US 2006/0266433 A1 Nov. 30, 2006

(30) Foreign Application Priority Data

Sep. 26, 2003 (FI) ..... 20031391

(51) Int. Cl.
*B27L 5/02* (2006.01)

(52) U.S. Cl. ..... 144/363; 144/209.1; 144/211

(58) Field of Classification Search ..... 144/213, 144/357, 365, 209.1, 363, 211, 212
See application file for complete search history.

(56) References Cited

U.S. PATENT DOCUMENTS

| | | | | |
|---|---|---|---|---|
| 3,866,642 | A | 2/1975 | Walser | |
| 4,396,049 | A | 8/1983 | Calvert et al. | |
| 4,506,714 | A | 3/1985 | Shrum et al. | |
| 4,708,180 | A | 11/1987 | Browning, Jr. et al. | |
| 4,791,970 | A | 12/1988 | Walser et al. | |
| 5,787,949 | A * | 8/1998 | Koike et al. | 144/357 |
| 5,791,388 | A * | 8/1998 | Nakaya | 144/357 |
| 6,484,768 | B2 * | 11/2002 | Puranen et al. | 144/213 |
| 2003/0075242 | A1 | 4/2003 | Puranen | |

FOREIGN PATENT DOCUMENTS

| | | |
|---|---|---|
| EP | 0247458 | 12/1987 |
| EP | 1034904 | 9/2000 |

* cited by examiner

*Primary Examiner*—Bena Miller
(74) *Attorney, Agent, or Firm*—Young & Thompson

(57) ABSTRACT

The invention concerns a method for peeling veneer from a log (2). Veneer (4) is peeled tangentially from the circumferential surface of a log rotated around its longitudinal axis under conditions determined by the distance (knife gap) between the knife (3) and the nose bar pressing the surface of the log immediately in front of the cutting point. The peeling knife as well as the nose bar is moved towards the rotation axis of the log corresponding the proceeding of the peeling. At the ending stage of the peeling, the distance between the peeling knife and the nose bar is reduced substantially in accordance with the thickness of the veneer being peeled.

4 Claims, 2 Drawing Sheets

METHOD FOR CUTTING VENEER FROM LOGS

Figure 1:
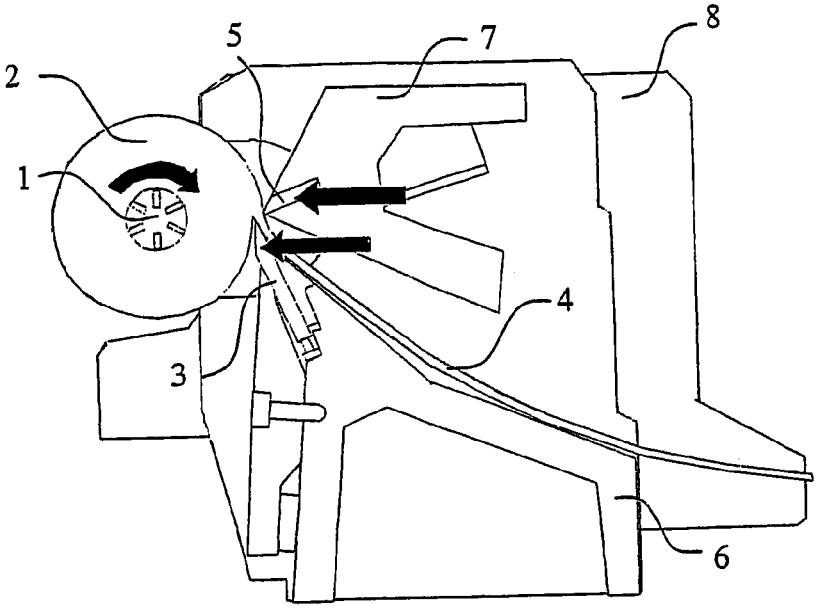
Fig. 1 (PRIOR ART)

The present invention concerns a method for cutting or more precisely for peeling veneer from a wood log. In this method, the initial stage and the main stage of the peeling are traditional. In the lathe, the log rotated on the spindles is rounded up in the initial stage by means of a so-called open knife setting, the nose bar of the lathe being in this stage in open-position, not in contact with the log. After the log is rounded up, the nose bar is lowered to its operation position, in other words pressing the surface of the log slightly at a small distance in front of the peeling knife. The distance between the nose bar and the peeling knife, the so called knife gap is chosen in accordance with the thickness of the veneer to be cut so, that the knife gap is slightly smaller than the nominal thickness of the veneer. The veneer is thereby cut under a light pressure caused by the nose bar. The pressure is determined according to the wood to be peeled and according to its condition.

The knife peeling the veneer and the nose bar travelling with it are moved, supported by a knife carriage of the lathe, corresponding to the proceeding of the peeling towards the log. The proceeding speed is naturally dependent on the thickness of the veneer to be cut, on the diameter of the log and on the speed of rotation thereof. The adjusted motion of the knife carriage is effected in general by an adjustable electric motor, suitable thereto being among others a dc-motor.

The peeling is performed under the above mentioned circumstances up to a certain remaining thickness of the log, in other words to the core thickness, which is determined by different factors, such as the tendency of the log to bend when getting thinner, tendency of the veneer to break when the log is getting thinner, etc.

The ending of the peeling when operating according to the methods of prior art is performed so that when the peeling knife has proceeded to a predetermined distance to the rotation axis of the peeled log, the proceeding of knife towards the log is stopped. The stopping is performed retarded, by braking the proceeding of the knife carriage, for instance by braking the drive motor. This has a result that from the retarding moment on, in practice during about 2 turns of the log, the peeling knife peels veneer getting thinner from the nominal thickness for a certain length of path, until the thickness of the veneer is theoretically zero. In practice, the cutting ends naturally before the zero-situation to the breakage of the veneer. In this ending stage when the veneer gets thinner, the nose bar loosens from the contact with the veneer surface, because its distance is adjusted according to the nominal thickness of the veneer.

As a result of the foregoing, the peeling is in practice performed by means of an open knife setting, which causes certain disadvantages. The surface of the veneer will be rough, as the knife tends to bite more of the log core, because the counter pressure of the nose bar is missing, which also leads to a prolonged ending stage of the peeling, and the veneer web does not break off properly at the ending stage of the peeling.

Figure 2:
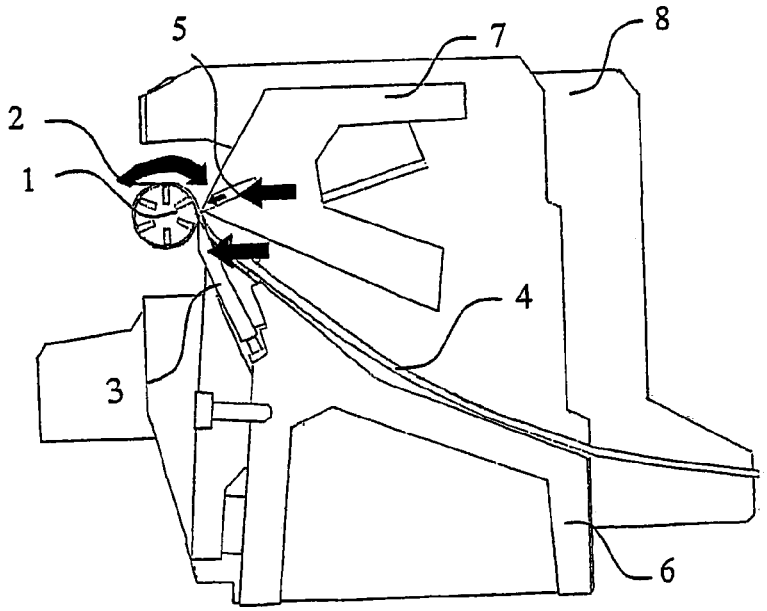
Figure 3:
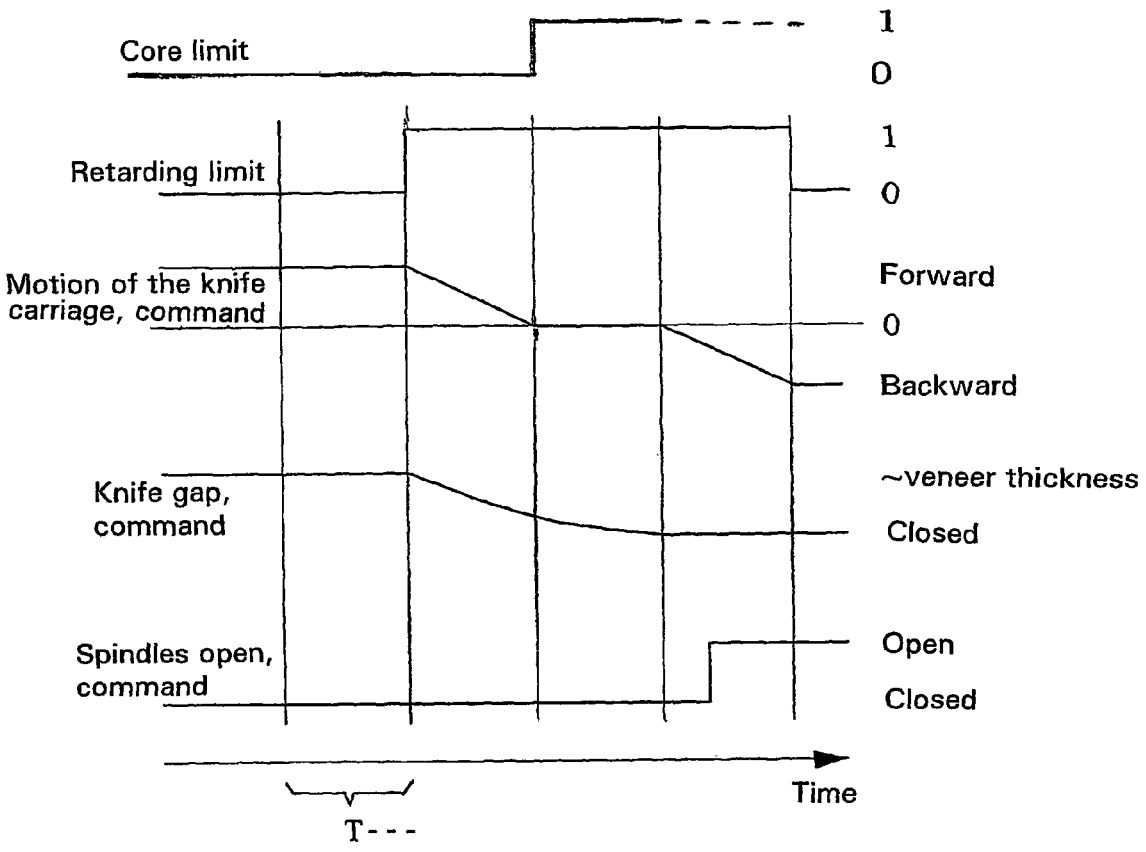

The invention will be described in more details in the following with respect to the enclosed drawing, wherein FIG. 1 shows the traditional veneer peeling as a general view, FIG. 2 shows as a schematic drawing the ending stage of the peeling in accordance with the present invention, FIG. 3 is a time diagram of partial factors of the peeling process in accordance with one embodiment of the present invention.

FIG. 1 shows a principal cross sectional view of a conventional veneer lathe during the peeling process. The log 2 to be peeled is at its both ends supported by the spindles 1 and rotated by them. The knife cutting veneer tangentially from the surface of the log as well as the nose bar abutting the log in the peeling process on the surface of the log are supported by their own knife holders (6, respectively 7), said holders being fixed to the ends 8 in a way known in the art and forming together with them a knife set carriage of the lathe.

The knife set carriage, and respectively the knives 3, 5 supported by it are fed during the peeling towards the log adjusted so that the thickness of the veneer 4 remains at its adjusted value. The feeding speed depends among others on the rotation speed of the spindles 1 and the thickness of the veneer to be cut. The controlled speed is provided for instance by means of an adjustable drive motor, for instance with a dc-motor.

When the peeling has proceeded to a predetermined log thickness, the peeling will be stopped by giving a halt instruction to the transferring devices. In practice, the proceeding of the massive knife carriage is not stopped immediately at the moment of the halt instruction, but it as well as the knife set assembly supported by it tends to proceed forced by the stored motion energy towards the peeled log. This proceeding is counteracted by the load caused by the peeling, but in order to make the stopping stage to be better controllable, also a braking command is usually included in the stopping command of the drive motor. With these measures, it is tried to stop the proceeding of the knife carriage during about one rotation of the log. From that moment on the knife still peels the log round, basically about during one rotation of the log. Thus, the ending stage of the peeling will be performed about during two rotations of the log. During this period the knife 3 still cuts from the surface of the block veneer, which will become thinner from the nominal thickness to zero, following the stopping phase of the knife carriage. The nose bar looses its contact with the surface of the log about at the moment (with a lag determined by the grade of pressing), when the thickness of the peeled veneer goes under the nominal thickness, that is, the open knife peeling stage has been reached with the problems mentioned above. The duration of this ending stage is dependent among others on the operating speed of the lathe.

When operating in accordance with the basic idea of the invention, the ending stage of the peeling is performed so that the distance between the knife 3 and the nose bar 5, in other words the knife gap is decreased in accordance with the thickness of the veneer being cut at a certain moment. Thus, the nose bar 5 is in contact with the surface of the log until the end of the peeling and gives a counter force to the knife 3, which prevents the knife from biting the log deeper than intended. The veneer is also supported till the end of the peeling stage, whereby its tendency to break is decreased.

The operation of a veneer lathe operating in accordance with the method of the invention at the ending stage of the veneer peeling is depicted in FIG. 2, in which an arrow shows the motion of the nose bar 5. For providing this motion no change of the construction of the lathe is necessarily required, because at least in the most modern lathes, the knife gap between the knife 3 and the nose bar 5 can be changed in the course of the peeling process, as is the case for instance at the boundary of the sapwood and heartwood of the log. When acting in accordance with the invention, the knife gap is decreased during the ending stage of peeling taking into account the pressing degree from the nominal thickness in principle up to zero (in practice nearly to zero because the web is broken before the zero). The control of the decreasing of the knife gap up to zero in the ending stage of peeling can be performed with a reasonable accuracy by an estimation, based on the data received from the control of the drive of the transfer device of the knife set carriage. A decisive moment for the control of the knife gap is the moment, when the drive gets the halt instruction of the ending stage. Also the information on the braking command included in the halt instruction is significant for evaluating, during how many rotations of log the peeling is finished.

In FIG. 3, the ending stage of the peeling in accordance with the invention has been visualized with respect to the dependency on time of different elements.

In FIG. 3, the events of the ending stage of a peeling process have been shown on a time section, where the knife set carriage together with the knife and the nose bar moving along are coming closer to the rounding stage of the core and further to the returning stage of the knife set carriage at the end of the peeling.

On the line segment of time of FIG. 3 the time has been marked as multiples of time of one revolution of the log, as sequences T.

In the first of the shown time sequences, the knife still peels normal veneer with its nominal thickness from the log. The knife set carriage proceeds towards the log with a speed defined by the nominal veneer thickness, the gap between the knife and the nose bar corresponds to the nominal thickness of the veneer (for the pressure degree smaller), the spindles rotating the log are in the state of log-rotating. At the end of the first time sequence T shown in the figure, the devices that effect the feeding motion of the knife set carriage receive a halt instruction. In this stage the proceeding of the knife set carriage is also tried to slow down so that the proceeding motion would stop about during one revolution of the log. The stopping point of the knife set carriage with respect to the peeled log determines the limit of the core and defines the log diameter at the end of the peeling, during about one additional revolution of the log.

As the proceeding speed of the knife carriage slows down, the thickness of the veneer being peeled by the knife from the log is reduced correspondingly. Therefore, in the operation in accordance with the invention, changing of the distance of the nose bar from the knife is required, in order to reduce the knife gap in proportion to the reduction of the veneer thickness.

In the operation model shown in FIG. 3, the motion of the knife set carriage towards the log has been described to be linear up to the stopped condition during the second shown time sequence T. Thus, the so-called core boundary has been reached, from which the core will be rounded up during one revolution of the log.

From this point on, on the time axis, the return motion of the knife carriage is started for a new peeling operation. The knife gap is in this point still closed and the spindles holding the veneer core are still in holding position. The spindles are opened at a suitable point of the return motion of the knife set carriage for dropping the core from the lathe. Also the nose bar is opened at a suitable point out of its operation position and held in this open-position until the end of the round-up stage of the new log.

Among advantages gained by means of the operation model in accordance with FIG. 3 is the good control of the ending stage of the veneer peeling. The wedge-shaped "fish tail" end of the veneer becomes homogenous and the veneer is also cut off at the wanted point. Also the core can be made absolutely round, which is essential for the further use of the core.

The invention is applicable also in a different way from the above described, using an accelerated formula. The accelerated operation can be used as well for the part of the speed reduction of the knife set carriage as for the part of the round-up stage from the stopping of the knife set carriage on.

The proceeding of the knife set carriage after the halt instruction can be retarded more strongly, less than during one revolution of the log, with slow lathes even without delay, whereby the ending stage takes place about during one revolution. As an alternative to this operation model or combined therewith, the knife gap can be reduced more quickly at the ending stage than what is required by the reduction of the veneer thickness, in other words the pressing degree can be increased at the ending stage of peeling, whereby the veneer is cut off before the end of the round-up revolution of the log. The core will not be round, but the cut-off of the veneer at the end is better controlled.

The invention claimed is:

1. A method for peeling veneer from a log, wherein veneer is peeled tangentially from the circumferential surface of a log rotated around its longitudinal axis under conditions determined by a constant knife gap between the knife peeling the veneer and a nose bar pressing the surface of the log immediately in front of the peeling point, moving the peeling knife as well as the nose bar towards the rotation axis of the log during the peeling, giving a halt command at a core diameter limit for said moving towards the rotation axis of the log, and substantially simultaneously with said halt command, giving a command to the nose bar to reduce the knife gap.

2. The method according to claim 1, wherein said command to the nose bar includes an instruction to reduce the knife gap in accordance with the reducing thickness of the veneer being peeled.

3. The method according to claim 1, wherein said command to the nose bar includes an instruction to reduce the knife gap slightly in advance of the reduction of the veneer thickness.

4. The method according to claim 1, wherein said moving towards the rotation axes of the log is stopped substantially during one revolution of the log from said halt command.

* * * * *